US005282721A

United States Patent [19]

Kildea

[11] Patent Number: 5,282,721

[45] Date of Patent: Feb. 1, 1994

[54] PASSIVE CLEARANCE SYSTEM FOR TURBINE BLADES

[75] Inventor: Robert J. Kildea, North Palm Beach, Fla.

[73] Assignee: United Technologies Corporation, Hartford, Conn.

[21] Appl. No.: 529

[22] Filed: Jan. 4, 1993

Related U.S. Application Data

[63] Continuation-in-part of Ser. No. 767,745, Sep. 30, 1991, abandoned.

[51] Int. Cl.[5] ..... F01D 5/18; F01D 5/20

[52] U.S. Cl. ..... 416/97 R; 416/228; 416/237; 415/173.1

[58] Field of Search ..... 416/90 R, 92, 97 R, 416/97 A, 228, 235, 236 R, 237; 415/115, 173.1

[56] References Cited

U.S. PATENT DOCUMENTS

| | | | |
|---|---|---|---|
| 1,955,929 | 4/1934 | Mueller | 416/235 |
| 4,390,320 | 6/1983 | Eiswerth | 416/92 |
| 4,589,823 | 5/1986 | Koffel | 416/92 |
| 4,863,348 | 9/1989 | Weinhold | 415/173.1 |

FOREIGN PATENT DOCUMENTS

| | | | |
|---|---|---|---|
| 2405050 | 8/1975 | Fed. Rep. of Germany | 416/92 |
| 135606 | 7/1985 | Japan | 416/97 R |
| 184905 | 9/1985 | Japan | 415/173.1 |
| 221602 | 9/1990 | Japan | 416/97 R |
| 710938 | 6/1954 | United Kingdom | 416/237 |

*Primary Examiner*—Edward K. Look
*Assistant Examiner*—James A. Larson
*Attorney, Agent, or Firm*—Norman Friedland

[57] ABSTRACT

Spent cooling air from the internal passage(s) in a turbine blade of a gas turbine engine are judiciously located to inject air at the pressure side of the blade in proximity to or in the gap between the tip of the blade and outer air seal to reduce leakage in the gap and improve engine performance. In one embodiment, a projection at the tip of the blade on the pressure side is utilized in combination with an angled discharge passageway and in another embodiment a pair of discharge angled passages, one interconnecting an internal passage on the pressure side and the other connecting an internal passage on the suction side of the blade is utilized. A projection at the tip adjacent the pressure side may also be incorporated in the second embodiment.

5 Claims, 3 Drawing Sheets

PASSIVE CLEARANCE SYSTEM FOR TURBINE BLADES

DESCRIPTION

This is a continuation-in-part of Ser. No. 07/767,745, filed Sep. 30, 1991, abandoned.

TECHNICAL FIELD

This invention relates to air cooled turbine blades for gas turbine engines and more particularly to means for utilizing the cooling air in combination with the air adjacent the surface of the blade for clearance control.

BACKGROUND ART

As is well known, leakage flow from the pressure side to the suction side of a turbine blade across the tip (the gap between the blade tip and the outer air seal) results in a performance loss of aircraft gas turbine engines. There has been over the years a continual effort to maintain a close clearance between the tips of an axial flow turbine blades and the outer air seal surrounding these tips for the entire operating envelope of the engine. As one skilled in the art appreciates, because the rotor has a greater mass than the engine casing, the rotor will expand and contract in response to temperature changes slower than the casing. The engine is initially designed so that the tips of the blades will not rub against the outer air seal for both transient and steady-state conditions. Hence, the gap must be sufficiently large to accommodate certain transient conditions and yet be small when the engine is operating at a steady-state condition. This presents problems since the gap is designed to obviate rubbing to accommodate the transient conditions. When the engine returns to the steady-state condition the gap is generally larger than desired unless means are taken to adjust for this problem. This problem is acerbated when an engine, particularly powering military fighter aircraft, is put through extreme transient conditions such as throttle chops, rapid re-accels and the like which require the engine case and rotor components to respond more rapidly than would otherwise be the case in a commercial airline. Presently, there are two fundamental ways in which this gap is controlled, one by an active control system and the other by a passive control system. Essentially, an active control system, sometimes referred to as active clearance control, typically relies on some external heat or cooling source and the actuation of an external control system that serves to conduct the heating or cooling from the source to the component parts in proximity to the blade so as to change their temperature in order to effectuate contractions or expansion of the involved components and hence change dimension of the gap. A passive system, on the other hand, relies on the surrounding environment to effectuate the gap closure. Examples of an active clearance control can be had by referring to U.S. Pat. No. 4,069,662, granted to Redinger et al on Jan. 24, 1978 and assigned to the assignee common to this patent application. Examples of a passive clearance control system can be had by referring to U.S. Pat. Nos. 3,575,523, granted to F. J. Gross on Apr. 20, 1971; 4,534,701 granted to G. Wisser on Aug. 13, 1985 and 4,863,348 granted to W. P. Weinhold on Sep. 5, 1989.

One method of reducing the leakage of air across the tip of the turbine is to discreetly inject the discharge air from the turbine blades internal cooling passages at judicious locations at the tip of the blade adjacent the pressure side of the blade. This serves to create a buffer zone and forms a curtain of air to effectively minimize the leakage occurring across the tip of the blade from the pressure side to the suction side.

DISCLOSURE OF THE INVENTION

An object of this invention is to provide for an axial flow turbine blade of a gas turbine engine improved passive means for reducing leakage of engine working medium adjacent the tip of the turbine blade.

A feature of this invention is the location of an axial projection located on the pressure side adjacent the tip of the blade that together with the discreet discharge of cooling air from the blade and the radial air flow adjacent the outer surface of the blade on the pressure side provides a "curtain" of air adjacent the tip of the blade to minimize leakage of the engine working medium at the tip of the blade.

A still further feature of this invention is to route the air internal of the blade adjacent the suction side of the blade to judiciously discharge air adjacent the tip of the blade at a discreet low angle.

A still further object of this invention is to provide a passive tip leakage reducing system at the trailing edge utilizing straight holes rather than curved holes that have been used heretofore.

The foregoing and other features and advantages of the present invention will become more apparent from the following description and accompanying drawings.

BEST MODE FOR CARRYING OUT THE INVENTION

Figure 1:
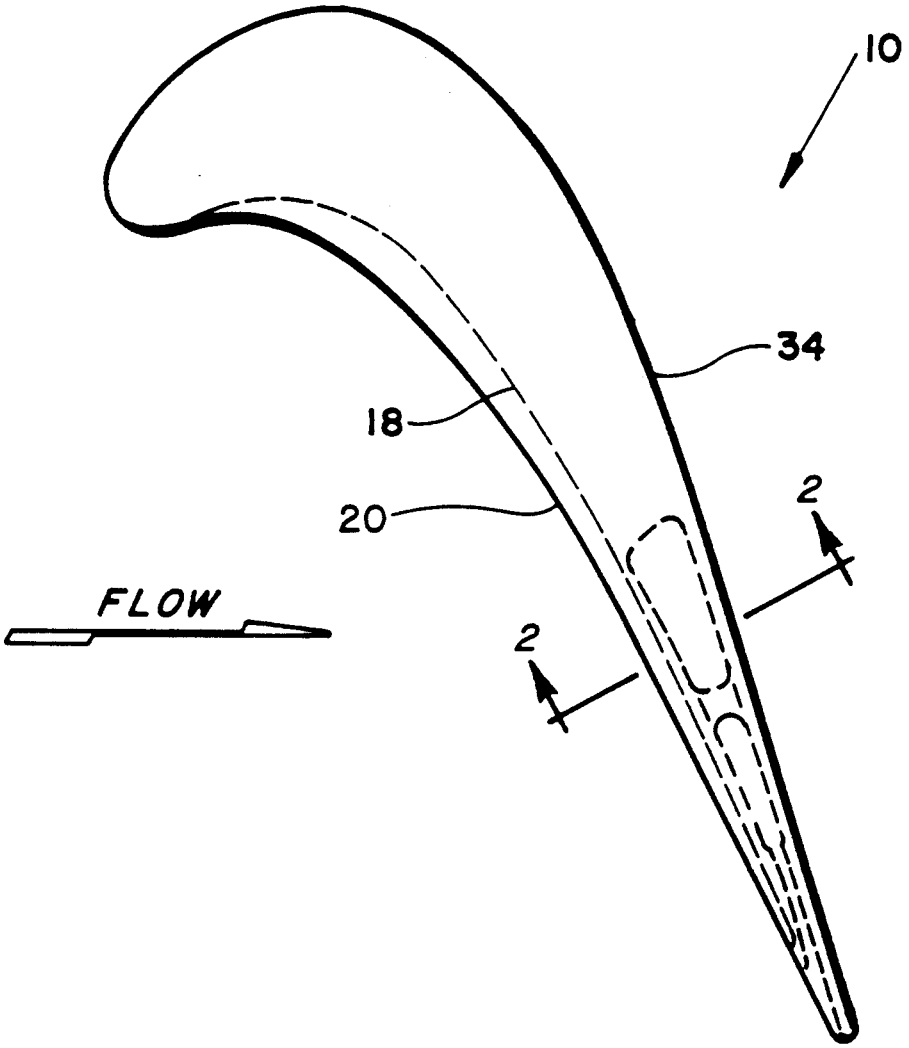
FIG. 1 is a top plan view of the axial flow turbine blade of a gas turbine engine.

While only two specific embodiments of turbine blades are disclosed herein, it will be understood that many of the internally air cooled turbine blades can utilize this invention. Additionally, for the sake of convenience and simplicity only a portion of the turbine blade is disclosed and for more details of a suitable blade reference is hereby made to the F100 family of gas turbine engines manufactured by Pratt & Whitney division of United Technologies Corporation, the assignee of this patent application. Suffice it to say, and referring to FIG. 1 the turbine blade generally illustrated by reference numeral 10 is one of a plurality of blades suitably supported in a disk and rotably mounted on the engine shaft for powering the engine's compressor (not shown). The engine's fluid working medium (gas generated by the burner) serves to impinge on the airfoil of the blade, which in turn, extracts a portion of its energy for driving the compressor while the remaining energy is utilized to develop engine thrust.

Figure 2:
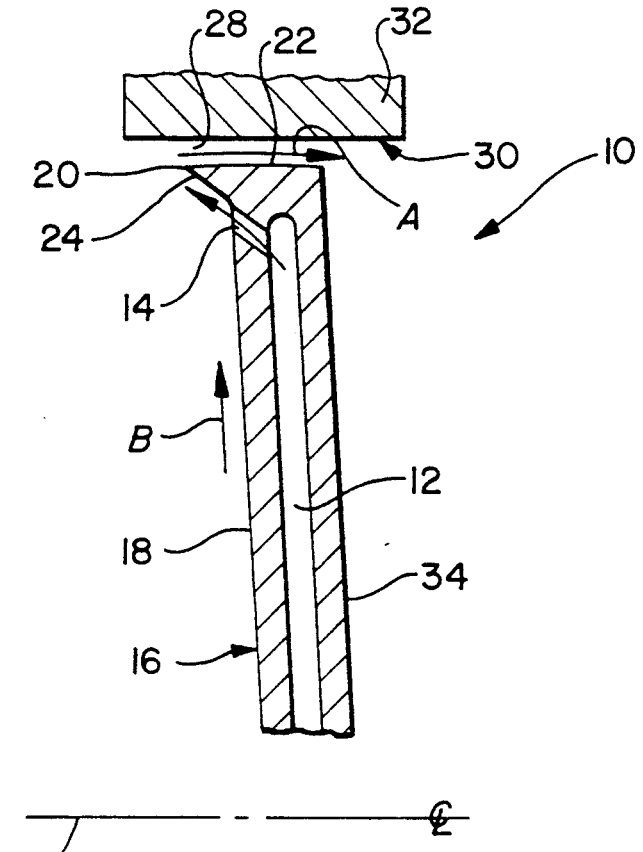
FIG. 2 is a sectional view taken along lines 2—2 of the trailing edge area of FIG. 1 shown in relationship to the outer air seal.

As best seen in FIG. 2, cooling fluid internally of the blade discharges from a plurality of holes 14 (one being shown) into the engine's fluid working medium from an internal cavity 12. As noted, the secondary flow, illustrated by arrow B, which is the engine's working medium adjacent the blades surface 16 on the pressure side 18 of the blade, travels in a radial direction relative to the engine's center line and combines with the flow discharging from orifice 14.

In accordance with this invention, a small projection 20 extending axially in the aft direction relative to the main stream of the engine's working medium is located at the tip 22 of blade 10. The holes 14 are drilled parallel to the angular wall 24 and are substantially equal to an angle that lies between and including 35° to 60° relative to the projected center line of the engine as viewed in FIG. 2 (designated by reference letter X) or relative to the surface of tip 22. The combined flow, i.e., the radial secondary flow and the discharge flow, serve to form a curtain of air adjacent the tip 22 and block the leakage flow illustrated by arrow A. The leakage flow that flows in the gap 28 formed between the tip 22 and outer face 30 of the outer air seal 32 is in the direction from the pressure side 18 to the suction side 34. This curtain of air adjacent the inlet end of the gap, reduces the amount of leakage flow that would otherwise occur. The reduction in leakage of the high energy fluid working medium causing the otherwise leakage flow to pass through the working surface of the blade enhances turbine performance and, hence, engine performance.

Figure 4:
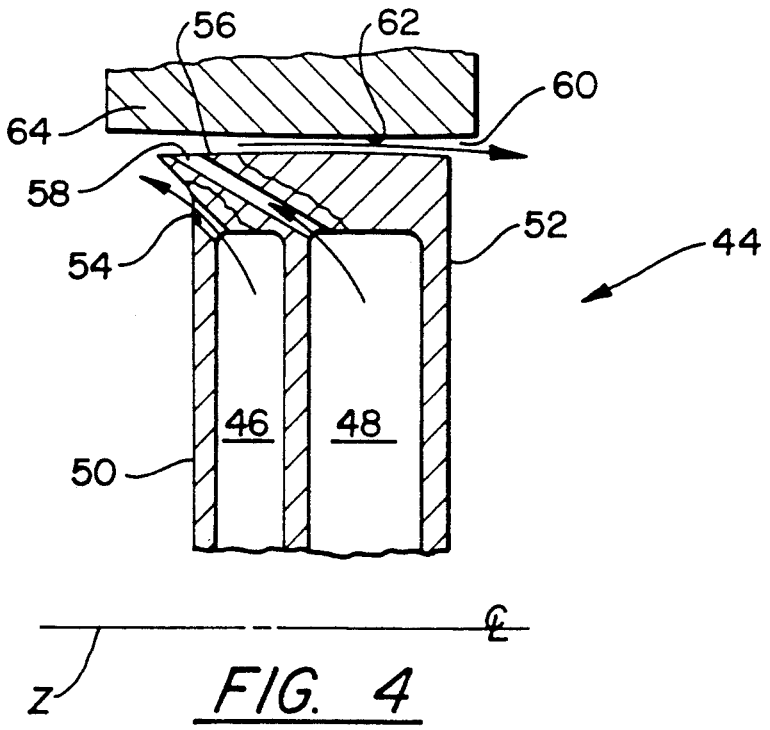
FIG. 4 is a sectional view taken along lines 4—4 of FIG. 3 shown in relationship to the outer air seal.
Figure 3:
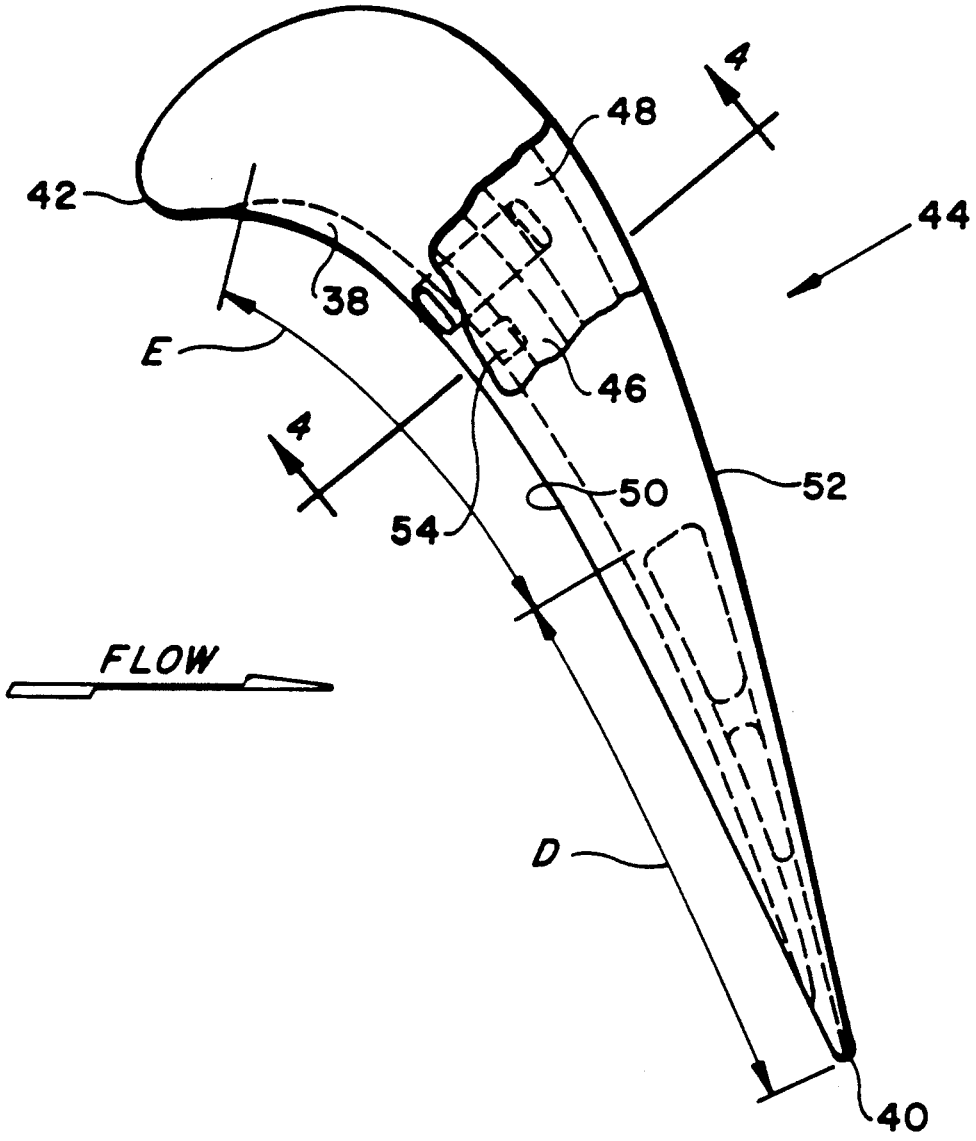
FIG. 3 is a top plan view similar to FIG. 1 of another embodiment of a blade utilizing this invention.

The second embodiment exemplified in FIGS. 3 and 4 is generally similar to the embodiment disclosed in FIGS. 1 and 2 save for the extended projection 38 corresponding to projection 20 of FIGS. 1 and 2 and the inclusion of internal cavity 48 adjacent the suction side 52. Referring more specifically to FIGS. 3 and 4, the blade generally illustrated by reference numeral 44 is bounded by the trailing edge 40, leading edge 42, the pressure side 50 and the suction side 52. For the purpose of this description, the portion of the blade extending between the dimensions denoted by the arrow D is the trailing edge region, the arrow E is the mid-portion region and the remaining portion is the leading edge region.

In accordance with this invention, the cooling air from the cavity 48 which is utilized for blade internal cooling is routed to the tip 56 of blade 44 through drilled holes or passageways 58. The passageway 58 is oriented such that the flow of air is injected at an angle that is relatively low, say between 35° and 60° with respect to the projected engine's center line (designated by reference letter Z) or with respect to the surface of tip 56. The injection of the air at this low angle serves to provide at the pressure side 50 a curtain of air adjacent gap 60 formed between tip 56 and the inner surface 62 of the outer air seal 64.

In certain embodiments, it would not be practical to provide such a curtain in the tip region because of the inherent design of the cooling passages in the blade.

As is apparent for the description above, the internal passages in the blade 44 include both the cavity 48 adjacent the suction side 52 and cavity 46 adjacent the pressure side 50. Both cavities extend radially in blade 44 and carry cooling air and are in proximity to the tip portion of blade 44. In this embodiment, air is directed to form a curtain at the tip 56 adjacent pressure side 50 by injecting air at a low angle from cavity 46 through drilled hole or passageway 54 and from cavity 48 through drilled hole or passageway 58 the drilled hole 58 is at a shallow angle similar to the angle of the slope of the projection 38 which angle is substantially equal to and including between 35° and 60° relative to the projected engine's center line or relative to the surface of tip 56. This assures that there will be a continuous sheet of high velocity air adjacent gap 60 to oppose leakage flow therein. A plurality of passageways 54 and 58 (only one of each being shown) preferably should be staggered along the length of the pressure side of the blade.

As is apparent from the foregoing, the cooling air which has been used to cool the blade 44, is utilized further for minimizing leakage occurring in gap 60. In one instance, the spent cooling air from the pressure cavity 46 (one being shown although some blades may have a plurality of such cavities) is combined with the natural radial secondary flow along the pressure side face and combined with the spent cooling air from the suction side cavity 46 (only one being shown although some blades may have a plurality of such cavities) and in the other instance a projection at the tip 56 is utilized depending on whether or not such a projection would be practical on the leading edge region of the blade.

In this embodiment, the injection of spent cooling air adjacent gap 60 is at a relatively low angle and is available from two separate cavities, located on both the pressure and suction sides of the blade for reducing tip leakage.

Although this invention has been shown and described with respect to detailed embodiments thereof, it will be understood by those skilled in the art that various changes in form and detail thereof may be made without departing from the spirit and scope of the claimed invention.

I claim:

1. A turbine blade for a gas turbine engine having at least one internal cooling passage internally of the turbine blade, said turbine blade being driven by engine fluid working medium and having an airfoil section including an outer wall defining a pressure surface, a suction surface, a tip and a lower end of said internal cooling passage for leading cooling air from said lower end to flow through said internal passage and discharge through a plurality of spaced holes formed in said outer wall, said turbine blade being rotatably mounted in said engine such that said tip is spaced adjacent an annular member which defines therewith a gap, the improvement comprising a projection having an outer surface extending axially from the tip of the airfoil in the same plane of the airfoil's tip surface and an inclined inner surface extending from the pressure surface to the end of said outer surface, and an angled hole disposed substantially parallel to said inclined inner surface extending through the outer wall on the pressure surface connecting said internal passage for leading spent cooling air externally of said blade in proximity to said projection at a location spaced from said tip such that the flow of spent cooling air flows along said inner surface of said projection toward said tip whereby said flow combines with said fluid working medium flowing radially adjacent said pressure surface so that the tendency of said engine fluid working medium from migrating into said gap is reduced and the performance of said turbine blade is enhanced.

2. A turbine blade as claimed in claim 1 wherein the angle of said hole is selected to inject the flow from said blade at an angle substantially equal to between 35 and 60 degrees relative to the center line of said engine.

3. A turbine blade for a gas turbine engine having a plurality of internal cooling passageways internally of the turbine blade, said turbine blade being driven by the fluid working medium of said engine having an airfoil section including an outer wall defining a pressure surface, a suction surface, a tip and a lower extremity, at least one of said plurality of internal cooling passageways being adjacent said pressure surface and another of said passageways being adjacent said suction surface, said turbine blade being rotatably mounted in said engine such that said tip is spaced adjacent an annular member which defines therewith a gap, the improvement comprising a projection having an outer surface extending axially from the tip of the airfoil in the same plane as the airfoil tip's surface and an inclined inner surface extending from the pressure surface to the end of said outer surface, a first acutely angled passageway substantially parallel to said inclined inner surface extending through the outer wall on the pressure surface connecting said one of said internal passageways adjacent said pressure surface for leading spent cooling air externally of said blade on said pressure side in proximity to said tip and a second acutely angled passageway extending through said outer wall on said tip surface connecting said one of said passageways adjacent said suction surface for leading spent cooling air to said gap in proximity to the pressure surface, such that the flow of spent cooling air from said first angled passageway flows along the pressure surface toward said tip and said gap and together with said flow from said second acutely angled passageway obstructs the flow in said gap to minimize the tendency of the fluid working medium to flow into said gap and enhance the performance of said turbine blade.

4. A turbine blade as claimed in claim 3 wherein the angle of first and second said angled passageways is selected to inject the flow from said blade at an angle substantially equal to between 35 and 60 degrees relative to the surface of the tip of the airfoil.

5. A turbine blade as claimed in claim 4 wherein the second angle passageway is staggered relative to said first angle passageway.

* * * * *